United States Patent [19]

Locke

[11] 3,993,180

[45] Nov. 23, 1976

[54] DRIVE MECHANISM FOR AN ASYNCHRONOUS PRINTER

[75] Inventor: Robert A. Locke, Lansdale, Pa.

[73] Assignee: Sperry Rand Corporation, New York, N.Y.

[22] Filed: Aug. 7, 1975

[21] Appl. No.: 602,728

Related U.S. Application Data

[63] Continuation of Ser. No. 436,667, Jan. 25, 1974, abandoned.

[52] U.S. Cl. ..... 197/49; 197/82; 197/90

[51] Int. Cl.[2] ..... B41J 1/32

[58] Field of Search ..... 197/48, 16, 49, 176–179, 197/65, 82, 90; 101/93.15, 93.16, 93.17, 93.18–93.19

[56] References Cited

UNITED STATES PATENTS

| | | | |
|---|---|---|---|
| 2,843,243 | 7/1958 | Masterson | 101/93.15 |
| 3,403,386 | 9/1968 | Perkins | 340/172.5 |
| 3,554,347 | 1/1971 | Perkins | 197/48 |
| 3,618,720 | 11/1971 | Linke | 192/21.5 |
| 3,651,914 | 3/1972 | Locke | 197/49 |
| 3,715,021 | 2/1973 | Caspari | 197/16 X |
| 3,724,631 | 4/1973 | Icaczens | 197/49 |
| 3,804,225 | 4/1974 | Vlin | 197/49 |

*Primary Examiner*—Ralph T. Rader
*Attorney, Agent, or Firm*—Griffin, Branigan and Butler

[57] ABSTRACT

A tabulation drive mechanism is described for use with an asynchronous printer mechanism of the sort including a rotating type wheel which has its characters arranged thereon along a helical path. The wheel is rotated continuously about the axis of the helical path during printing and a print drive mechanism includes a lead screw which is coupled to the wheel. A rack and pawl mechanism selectively holds the print wheel at columnar printing positions. The tabulation drive mechanism is basically independent of, and in addition to, the lead screw for driving the print wheel to the right or left during tabulation. The tabulation drive mechanism includes two oppositely acting motors which are linked to the print wheel via magnetic particle clutches. A logic circuit activating the magnetic clutches coordinates the print and tabulation drive mechanisms.

8 Claims, 3 Drawing Figures

DRIVE MECHANISM FOR AN ASYNCHRONOUS PRINTER

This is a continuation of application Ser. No. 436,667, filed Jan. 25, 1974, now abandoned.

BACKGROUND OF THE INVENTION

This invention relates to a printer mechanism and, more particularly, to an improvement over the devices described in U.S. Pat. Nos. 3,651,914 to Locke and 2,843,243 to Masterson.

The printer mechanism shown in the above patents comprises a rotating print member which in the preferred embodiment is a print wheel. The print wheel has a series of type characters arranged to lie in a helical path about the periphery of the wheel. The axis of rotation of the wheel parallels a print line and the wheel is continuously rotated about its axis as it is, at the same time, moved along its axis. The pitch of the helical path defined by the type characters is set to so compensate for the movement of the wheel along its axis that all the characters will scan past a first columnar print position during one revolution of the wheel and then scan past the second columnar print position during the second revolution and so on.

The advantages and flexibility of such a printer are extended by making it asynchronous in operation so that the wheel is selectively moved along its axis only after a character has been received from a data source and is ready to be printed. With this type of operation a printer which has a certain maximum printing rate can be made to print at any slower rate without the need for elaborate synchronizing circuits. Thus such a printer mechanism can be operated directly from a data line terminal, a keyboard or any of a number of other data sources with a minimum amount of interfacing problems.

It is, important to note that the transaction output rate of this type, as well as other types, of printing machines depends to a great extent on the tabulating and carriage return speed of the printer. The tabulating speed is the time it takes a printer carriage (or print wheel) to move from one area of a horizontal format to another area without printing.

In this regard, in the prior art, the mechanism to move a printing carriage to the right is provided by a lead screw, which is restricted to the speed of printing, and the mechanism to move the printing carriage to the left is provided by a spring, which is difficult to selectively initiate and terminate at desired carriage positions. Thus, it is an object of this invention to provide an additional motion source, independent of a lead screw, for producing motion of a printing carriage during tabulation and carriage return, which is fast and reliable in operation, flexible in application and is compatible with lead-screw motivated mechanisms.

BRIEF SUMMARY OF INVENTION

In accordance with principles of this invention, a printer mechanism has a tabulation drive mechanism which includes two oppositely acting motors linked to a printwheel carriage via magnetic particle clutches. The clutches are energized at appropriate times and in appropriate directions by logic circuitry to stop, start and register the carriage.

Figure 1:
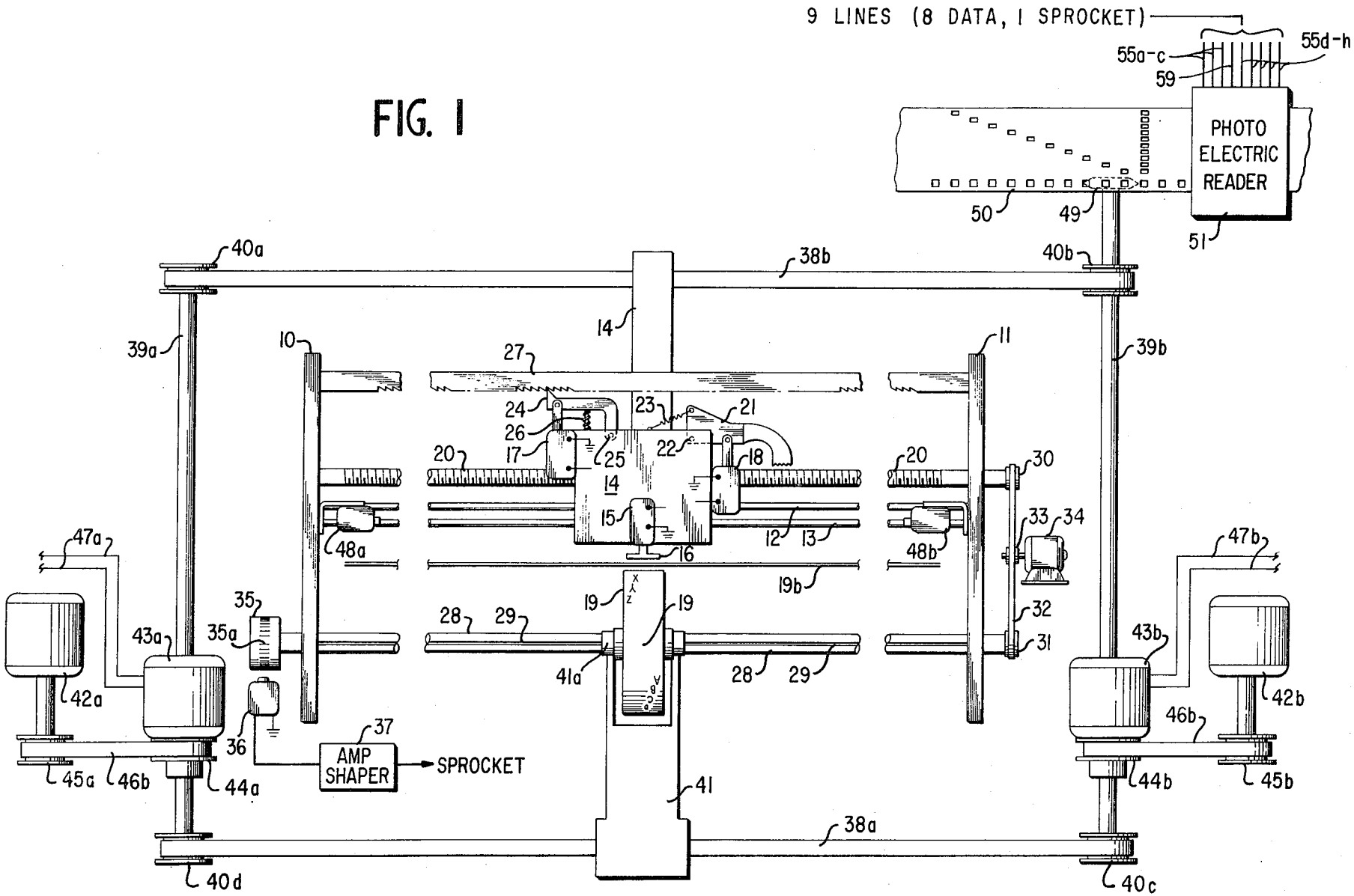
FIG. 1 is a diagrammatic drawing of a printer mechanism of this invention when view from above.

Reference is now made to FIG. 1 where there is shown at 10 and 11 a pair of end plates, cast metal for example, or support members for supporting a printing mechanism. Disposed between the end plates 10 and 11 are a pair of guide rods 12 and 13 on which a hammer carriage 14 is mounted for translation between the end plates 10 and 11.

The hammer carriage 14 carries a print actuator solenoid 15 and a print hammer 16. To effect the translation of the carriage 14, a lead screw 20 extends between the end plates 10 and 11 and is journaled for rotation in each of the end plates as indicated. The right-hand end of the lead screw 20 terminates externally of the end plate 11 in a suitable pulley member 30.

A lead screw pawl 21 is pivotally mounted as shown at 22 on the hammer carriage 14 and is adapted to engage the lead screw 20 in order to impart motion to the hammer carriage 14 during printing modes of operation. The lead screw pawl 21 is normally biased out of engagement with the lead screw as by spring 23 and a solenoid 18 is linked to the lead screw pawl 21 so that upon energization of the solenoid 18 the lead screw pawl 21 is pulled into engagement with the lead screw 20. The lead screw 20, which is continuously rotated, operates with lead screw pawl 21 engaged, to move the carriage 14 in a left to right direction during printing.

Also extending between end plates 10 and 11 is a rotatable shaft 28 which has a longitudinal keyway cut therein as shown at 29. Shaft 28 is journaled at each end in end plates 10 and 11 as shown, and the right-hand end of shaft 28 terminates in a pulley 31 which has a belt 32 linking it and the pulley 30. A drive pulley 33 attached to a motor 34 operates via the belt 32 and pulleys 30 and 31 to synchronously drive the lead screw 20 and shaft 28.

Mounted on shaft 28 and rotated therewith is a helical-type wheel 19. Type wheel 19 is keyed to shaft 28 so as to rotate therewith while at the same time it is free to be translated along shaft 28. The type wheel 19 contains a set of type characters which are helically placed about the perimeter of the wheel and arranged so that the pitch of the helix defining the character path corresponds to the pitch of the lead screw 20.

The left-hand end of shaft 28 terminates in a sprocket wheel 35 which, in this illustration, is a magnetic sprocket wheel. The sprocket wheel 35 contains a separate magnetic spot **35*a* recorded thereon for each character on the type wheel 19. In a typical case, 64 characters and 64** sprocket pulses may be used.

Located next to the sprocket wheel 35 is a magnetic pick up head 36 which senses the sprocket pulses on the sprocket wheel 35 and applies them to an amplifier shaper circuit 37 where the sprocket pulses are amplified and shaped and used to control an electronic printing circuit in the printer.

Motion between the type wheel 19 and the print hammer 16 is synchronized by means of front and rear belts **38*a* and *b*, first and second drive shafts 39*a* and *b* and four pulleys 40 *a–d*. In this regard, the hammer carriage 14 and a type-wheel carriage 41 respectively interconnect the print hammer 16 and the type wheel 19 with the top portions of the belts 38*a* and *b*. The print-wheel carriage 41 is attached to a collar 41*a* of the print wheel 19, which rides in the keyway 29 in such a manner that it does not inhibit rotation of the print wheel 19. Thus, the print hammer 16 and the print wheel 19 move in unison. The front and rear belts and the pulleys 40** *a–c* are toothed, to ensure registration.

An additional motion source for tabulation and carriage return is provided by first and second motors 42*a* and *b* which drive or brake the first and second drive shafts 39*a* and *b* via first and second magnetic particle clutches 43*a* and *b*. The principles upon which magnetic particle clutches operate are well known as are the structures for various types of magnetic particle clutches, therefore, it is not thought necessary to set these forth in detail here. The first and second magnetic particle clutches 43*a* and *b* could be of the type described in U.S. Pat. No. 3,618,720 to Linke; however, other types of magnetic particle clutches could also be used.

Basically, the first and second motors 42*a* and 42*b*, respectively, continuously drive input hubs 44*a* and *b* of the first and second magnetic particle clutches 43*a* and *b* via motor pulleys 45*a* and *b* and belts 46*a* and *b*. When the first and second magnetic particle clutches 43*a* and *b* are energized via electrical energizing lines 47*a* and *b* the input hubs are respectively coupled to the drive shafts 39*a* and *b* and when they are not energized the input hubs and drive shafts are not so coupled. The first motor 42*a* rotates in a direction to drive the carriages 14 and 41 to the left and the second motor 43*b* rotates in direction to drive the carriages 14 and 41 to the right. In addition to driving, the first and second magnetic particle clutches 43*a* and *b* can be used to brake carriage motion caused by the other.

Also extending between the end plates 10 and 11, and anchored at each end thereto, is rack member 27 which has a saw tooth milled therein for each print column so that the spacing of the teeth corresponds to the columnar spacing of the print line. Engaging the rack 27 is a rack pawl 24 which is pivotably mounted as at 25 to the hammer carriage 14. Rack pawl 24 is normally urged to engage the rack 27 by means of a compression spring 26. Also linking the rack pawl 24 is a solenoid 17 which upon energization causes the pawl rack 24 to disengage from the rack 27.

Mounted adjacent to the end plates 10 and 11 are left and right switches 48*a* and *b*. The left switch 48*a* is positioned so that it is actuated when the carriages are between columnar print positions 1 and 2 and the right switch 48*b* is positioned so that it is actuated when the carriages have passed beyond the last columnar print position.

A carriage position reader comprises a sprocket wheel 49 mounted on the drive shaft 39*b*. The sprocket wheel 49 drives a punched tape 50 longitudinally. Punched holes on the punched tape 50 are read by a photoelectric reader 51. The photoelectric reader 51 provides an eight (8) bit binary value for each carriage position on lines 55 *a–h* and a sprocket signal on line 59.

Before leaving the description of FIG. 1 it should be noted that the print receiving medium is shown disgrammatrically at 19*b*, while the inking mechanism for wheel 19 has been omitted for purposes of simplification.

Figure 2:
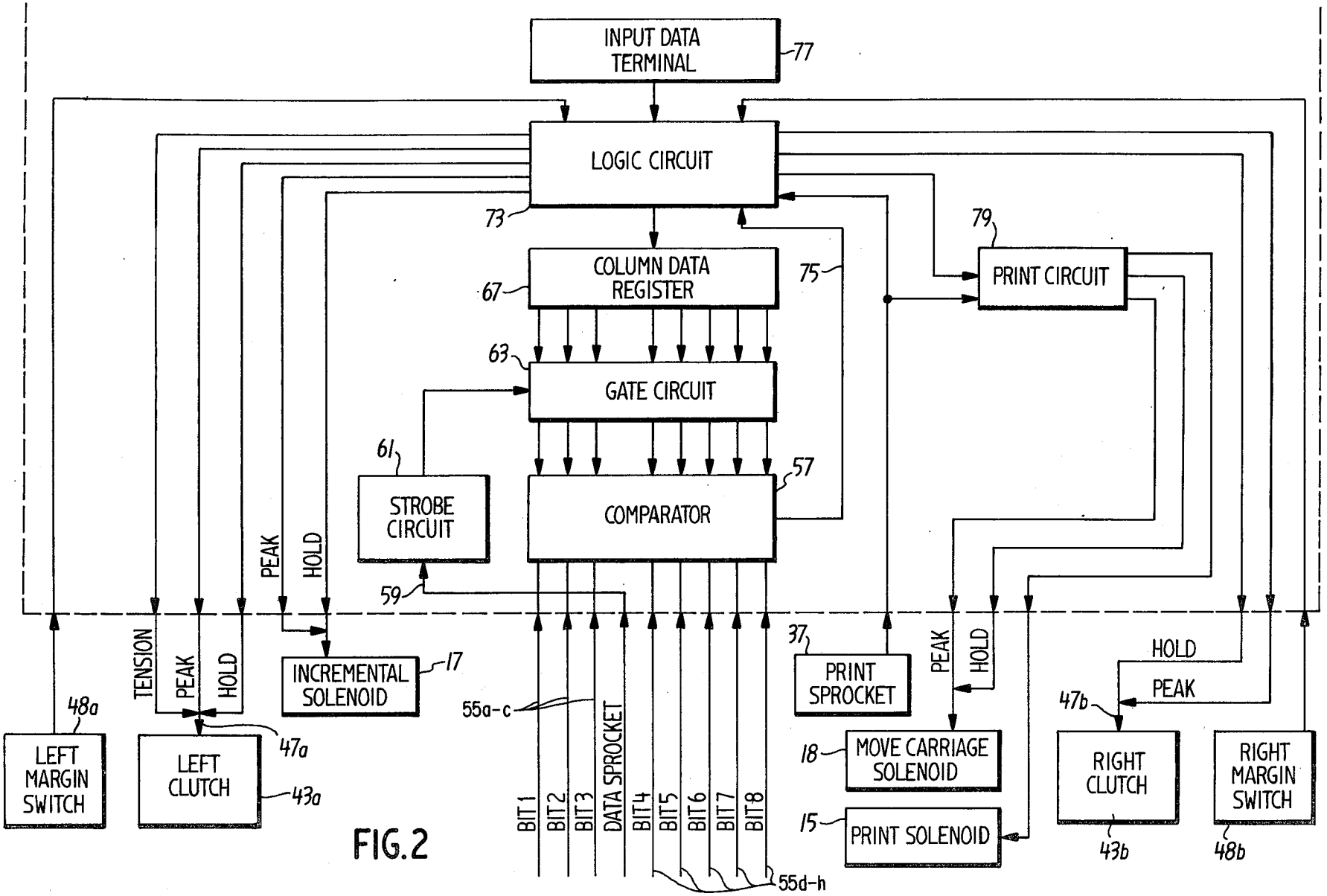
FIG. 2 is a block diagram showing a basic control logic system for the printer mechanism of FIG. 1.

With reference to FIG. 2, the binary value indicative of carriage position on lines 55*a–h* is fed to a comparator 57. The sprocket signal is fed on the line 59 to a strobe circuit 61.

The strobe circuit 61 controls a gate circuit 63 to strobe counts from the column data register 67 into the comparator 57 to be compared with the carriage position value at each column. The column-data register 67 is continually reset during operation, as is described below, by a logic circuit 73.

The comparator 57 informs the logic circuit 73 on a line 75 when there is identity between the column data register count and a carriage position count.

An input data terminal 77 can receive data from a data line terminal, a keyboard, a tape transcriber, or any of a number of data sources for providing control information to the logic circuit 73.

The logic circuit 73 also receives information from the left margin switch 48*a* as to when carriages 14 and 41 are between print columns 1 and 2. The left margin switch signal aids in stopping the carriages 14 and 41 during left motion to a column 1 position as is described below. The right-margin switch 48*b* informs the logic circuit 73 that the carriages have been moved too far to the right. The print sprocket 37 informs the logic circuit 73 of the angular position of the type wheel 19.

The logic circuit 73 uses the information from these input sources to print, tabulate and provide carriage return.

To print, the logic circuit 73 monitors the print sprocket 37 to determine the proper time for engaging the move-carriage solenoid 18 to begin printing. At the appropriate time, the logic circuit 73 energizes the incremental solenoid 17 to disengage the rack paw 24 and feeds characters to a print circuit 79. The print circuit 79, in response thereto, sends peak and hold signals to the move-carriage solenoid 18 to allow print motion of the carriage 14 and 41. The peak signal is of relatively large current to insure a fast response of the move-carriage solenoid 18, however, the peak signal is quickly cut off and the smaller hold signal maintains the move-carriage solenoid 18 in a position for engaging the lead-screw pawl 21 with the lead screw 20. Simultaneously, the logic circuit 73 maintains a left-clutch tension signal to load the pawl 21 against the screw 20. At appropriate times thereafter, the print solenoid 15 is activated by the print circuit 79 to print appropriate characters on the receiving medium 19*b*. The print circuit 71, and its associated controlling mechanisms are not really a part of this invention and are, therefore, not described in detail herein. This circuit could take various forms; and one such form is described in U.S. Pat. No. 3,651,914 to Locke which is hereby incorporated by reference into this specification.

The print circuit 79 continues to appropriately energize the move-carriage solenoid 18 and the pring solenoid 15 as long as characters are continuously fed to the print circuit 79. However, when no more characters are fed to the print circuit 79, it deenergizes the move-carriage solenoid 18 and the logic circuit 73 deenergizes the incremental solenoid 17. The tension signal, of small magnitude, is maintained to bias the carriage 14 and 41 toward the left to thusly urge the rack pawl 24 against an appropriate tooth in the rack 27. Thus, the carriages 14 and 41 are held stationary with the rack pawl 24 engaged in a tooth at a particular column position.

Figure 3:
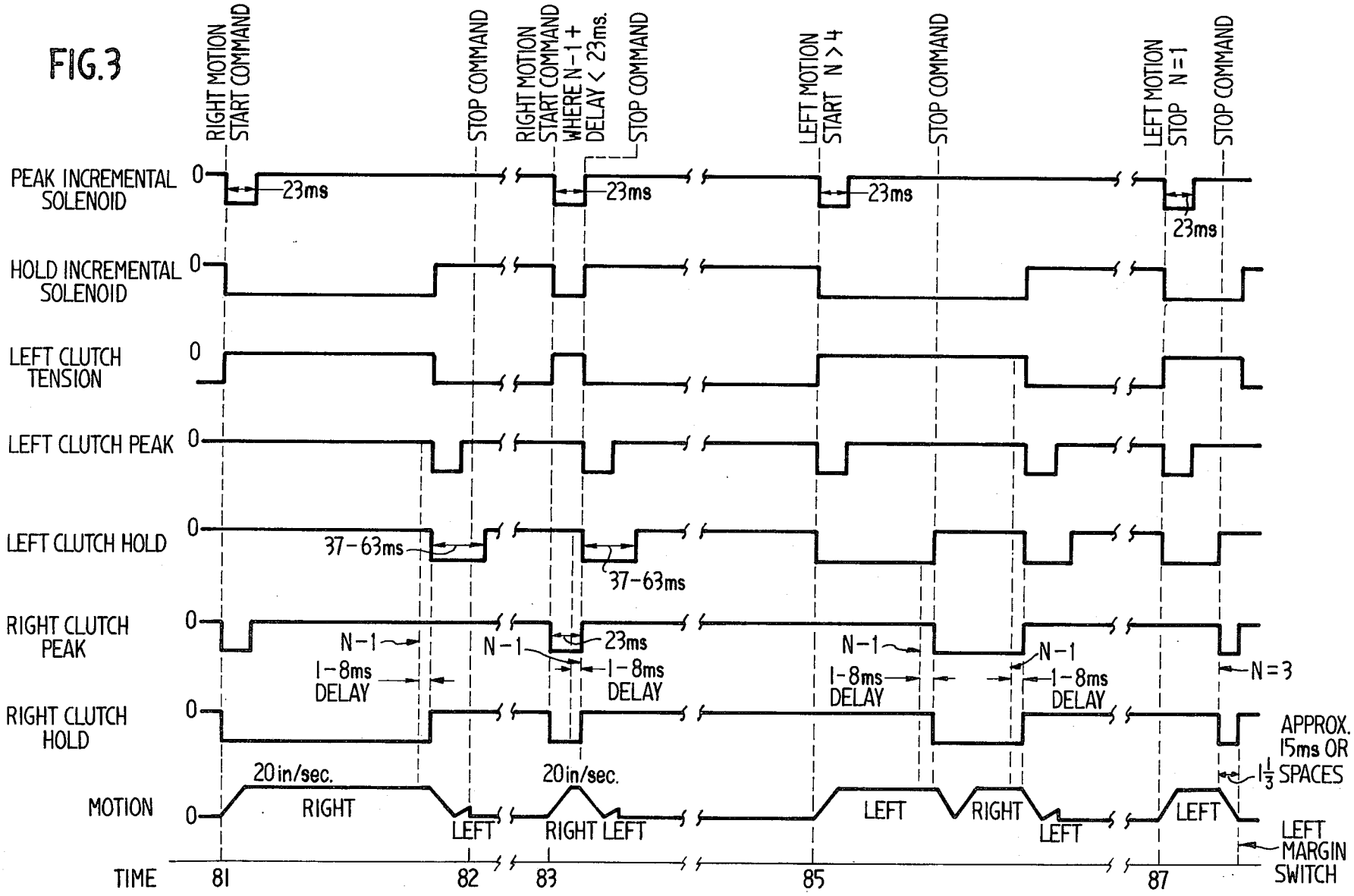
FIG. 3 is a set of timing diagrams useful in illustrating the operation of the printer mechanism of FIG. 1.

To tabulate the printer of FIGS. 1 and 2, with reference to FIG. 3, when the logic circuit 73 receives orders from the input data terminal 77 to tabulate the carriages 14 and 41 to the right, as at time 81, it energizes the incremental solenoid 17 to pull the rack pawl 24 out of engagement with the rack tooth by means of peak and hold signals. Simultaneously, the tension signal to the left clutch 43*a* is cut off and the right clutch 43*b* is energized by means of peak and hold signals. The peak signals are of relatively high current but last only 23 milliseconds. These signals insure rapid responses of activated elements. Carriage motion rapidly accelerates to 20 inches per second.

The logic circuit 73 also, simultaneously therewith, places a count on the column-data register 67 which is indicative of the column preceding the column at which the carriages 14 and 41 should stop (column N − 1). This count is continuously compared with the carriage-position count in the reader 51. When the carriages 14 and 41 arrive at column N − 1 the comparator 57 informs the logic circuit 73. The logic circuit 73, at a predetermined delay of from 1 to 8 milliseconds, deenergizes the incremental solenoid 17 to engage the pawl 24; energizes the left clutch 43*a* with peak and hold signals to provide a breaking action and with a tension signal to provide a leftward bias; and deenergizes the right clutch 43*b* to deactivate the rightward driving force. The carriages continue to move to the right at a decelerating pace with the pawl 24 clicking over the tooth of the rack 27 at position N. The delay is adjustable and is set so that the carriage will attain a zero rightward speed while the pawl 24 is riding upwardly on the tooth to the right of the tooth at columnar position N. The carriages 14 and 41 then begin a leftward motion until the pawl 24 engages the tooth at position N and is thereby brought to a halt at time 82. The left clutch peak and hold signals are removed leaving the left clutch tension signal to hold the carriages 14 and 41 in this position. It should again be noted that the left clutch tension signal is of relatively small current and merely provides a leftward biasing force to the carriages.

As mentioned above, the peak signals are set to have 23 millisecond durations. When it is desired to move the carriages 14 and 41 to the right to a column N, where the length of time required for the carriages to move to position N − 1 plus the time delay is less than 23 milliseconds, beginning at time 83 in FIG. 3, the system is prevented from actually stopping the carriages until the 23 millisecond right clutch peak signal is completed. For this reason, the minimum tabulation length in the disclosed system is three columns.

Where the carriages 14 and 41 are to be tabulated to the left to any columnar position greater than 4, beginning at time position 85 in FIG. 3, the incremental solenoid 17 is energized to disengage the pawl 24 from the rack 27, the left clutch tension signal is cut off, and the left clutch is activated by a peak and hold signal to drive the carriages to the left. Again, the logic circuit 73 places an N − 1 count signal on the column-data register 67 so that the comparator 57 informs the logic circuit 73 when the carriages 14 and 41 have passed columnar position N to arrive at columnar position N − 1. After the same delay previously mentioned of from 1 to 8 milliseconds the left clutch is deactivated and the right clutch is activated, both with peak and hold signals. The carriages 14 and 41 slow to a halt and finally begin moving in the right direction. Again, the carriages 14 and 41 pass the columnar position N − 1 and the logic circuit 73 is so informed by the comparator 57. This time, however, after the delay, the carriages 14 and 41 make their stop and registration at position N as previously described for right motion.

Under the system described here, the carriages 14 and 41 cannot be stopped at columnar positions 2, 3 and 4 because the right clutch peak signal has a predetermined duration of 23 milliseconds which would cause the carriages to overshoot columnar positions 2, 3 and 4 on the registration procedure.

However, the carriages can be made to stop at columnar position 1 as is indicated in FIG. 3, beginning at time position 87. In this case, the logic circuit 73 keys on columnar position 3. The logic circuit 73 is informed when carriages 14 and 41 arrive at columnar position 3. The appropriate action is taken to stop leftward motion by energizing the right-clutch peak and hold signals. When the left margin switch is contacted, a signal is sent to the logic circuit 73 to terminate the right-clutch peak and hold signals. The left-clutch tension signal is reestablished and the incremental pawl signal is deactivated so that the carriages come to rest in a tooth at columnar position 1.

It will be appreciated by those skilled in the art that the magnetic-particle motion source described herein provides fast horizontal tabulation both to the right and left, and, therefore, increase the overall speed at which an asynchronous printer operates.

While the invention has been particularly shown and described with references to a preferred embodiment, it will be understood by those skilled in the art that various changes in form and detail may be made therein without departing from the spirit and scope of the invention.

What is claimed is:

1. A printer mechanism for printing symbols along a print line on a print-receiving medium comprising:

a carriage means including a printing member having a series of type elements arranged thereon and a print actuating means for causing contact with said print-receiving medium along said print line;

motivating means for providing motivating energy;

printing drive linkage between said motivating means and said carriage means to drive the carriage means along a line parallel to said print line and to drive said printing member for positioning said type elements synchronously with movement of said carriage means along said print line, during a printing mode of operation when said print actuating means is selectively energized to print on said print-receiving medium, said printing drive linkage including a rotating lead screw and a pawl means mounted on said carriage means for engaging said lead screw during said printing mode of operation but for being disengaged from said lead screw during a tabulating mode of operation;

a separate tabulating drive linkage between said motivating means and said carriage means to drive said carriage in either direction along said line parallel to said print line during the tabulating mode of operation, said tabulating drive linkage including a clutch means for engaging to drive said carriage means asynchronously with movement of said printing member during the tabulating mode; and a control unit for actuating said pawl means and said clutch means.

2. A printer mechanism as claimed in claim 1 wherein said motivating means comprises separate right and left motors for motivating said tabulating drive linkage and said clutch means comprises right and left clutches for respectively connecting said right and left motors to said drive linkage, said clutches being activated and deactivated by said control unit.

3. A printer mechanism as claimed in claim 2 wherein said clutches are magnetic-particle clutches.

4. A printer mechanism as claimed in claim 1 wherein said printing linkage comprises a constantly rotating lead screw and a means is included for selectively coupling and decoupling said carriage to said lead screw and said clutch means includes right and left acting clutches.

5. A printer mechanism as claimed in claim 4 wherein said tabulating drive linkage includes an endless drive member driven by each of said right and left clutches and affixed to said carriage means.

6. A printer mechanism as claimed in claim 1 wherein said clutch means includes right and left acting clutches and wherein said tabulating linkage includes an endless drive member driven by each of said right and left acting clutches and affixed to said carriage.

7. A printer mechanism as in claim 1 wherein said tabulating drive linkage includes an endless drive member riding on wheels located on opposite sides of said carriage means, said endless drive member being attached to said carriage means along the length of said endless drive member between said wheels, said clutch means including two clutches for driving said endless drive means in either of opposite directions.

8. A printer mechanism for printing symbols along a print line on a print-receiving medium comprising:

a carriage means including a printing member having a series of type elements arranged thereon and a print actuating means for causing selected type elements of said printing member to come into contact with said print-receiving medium along said print line;

motivating means for providing motivating energy;

printing drive linkage between said motivating means and said carriage means to drive the carriage means along a line parallel to said print line during a printing mode of operation when said print actuating means is selectively energized to print on said print-receiving medium along said print line; and tabulating drive linkage between said motivating means and said carriage means to drive said carriage in either direction along said line parallel to said print line during a tabulating mode of operation, said tabulating linkage including an endless drive member riding on wheels located on opposite sides of said carriage means, said endless drive member being attached to said carriage means along the length of said endless drive member between said wheels, said linkage including two clutch means for enabling and disabling said linkage to drive said endless drive means in said either of opposite directions, said tabulating drive linkage thereby being separate from said printing drive linkage.

* * * * *